United States Patent [19]

Woodward et al.

[11] Patent Number: 4,562,145

[45] Date of Patent: Dec. 31, 1985

[54] PHOTOGRAPHIC BASE PAPERS

[75] Inventors: Antony I. Woodward, Amersham; George Tyler, Prestwood; John Lovick, High Wycombe, all of England

[73] Assignee: The Wiggins Teape Group Limited, England

[21] Appl. No.: 505,842

[22] Filed: Jun. 20, 1983

Related U.S. Application Data

[63] Continuation of Ser. No. 284,140, Jul. 7, 1981, abandoned, which is a continuation of Ser. No. 138,322, Apr. 8, 1980, abandoned.

[30] Foreign Application Priority Data

Apr. 20, 1979 [GB] United Kingdom ..... 7913740

[51] Int. Cl.[4] ..... G03C 1/76

[52] U.S. Cl. ..... 430/538; 430/536; 427/391; 428/513

[58] Field of Search ..... 430/531, 532, 536, 537, 430/538; 428/513; 427/391

[56] References Cited

U.S. PATENT DOCUMENTS

| | | | |
|---|---|---|---|
| 3,310,575 | 3/1967 | Spivack | 260/429 |
| 3,501,298 | 3/1970 | Crawford | 430/538 |
| 3,525,621 | 8/1970 | Miller | 430/538 |
| 3,582,339 | 6/1971 | Martens et al. | 430/538 |
| 3,607,345 | 9/1971 | Thomas et al. | 430/538 |
| 3,658,573 | 4/1972 | Guestaux et al. | 430/538 |
| 3,853,585 | 12/1974 | Tatsuta et al. | 430/538 |
| 3,853,592 | 12/1974 | Crawford et al. | 430/538 |
| 4,115,125 | 9/1978 | Etter et al. | 430/538 |

FOREIGN PATENT DOCUMENTS

| | | |
|---|---|---|
| 948880 | 2/1954 | United Kingdom . |
| 1081825 | 1/1966 | United Kingdom . |
| 1033258 | 6/1966 | United Kingdom . |
| 1134211 | 11/1968 | United Kingdom . |
| 1341688 | 12/1973 | United Kingdom . |
| 1361219 | 7/1974 | United Kingdom . |

*Primary Examiner*—Jack P. Brammer

*Attorney, Agent, or Firm*—Burns, Doane, Swecker & Mathis

[57] ABSTRACT

A photographic base paper in which the resin coating contains a stabilizer of formula,

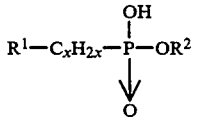

wherein $R^1$ is a sterically hindered hydroxyphenyl $R^2$ is $C_1$–$C_{12}$ alkyl, and x is 1 to 4, or a metal salt of the corresponding phosphonate anion.

26 Claims, No Drawings

PHOTOGRAPHIC BASE PAPERS

This application is a continuation of application Ser. No. 284,140, filed July 7, 1981, now abandoned, which is a continuation of U.S. Ser. No. 138,322, filed Apr. 8, 1980, now abandoned.

This invention relates to resin coated photographic base papers and a process for their preparation.

A considerable amount of the photographic base paper used in the world is of the resin coated kind. It is used by sensitisers as an image-receiving base for prints produced by a number of different photographic processing systems, including chemical transfer offset, instant photography, and, in particular, the conventional negative-positive process system. The resulting print essentially consists of resin-coated base paper and an image-containing layer which is adhered to the resin. In the negative-positive process where the image-containing layer is referred to as the emulsion coating, a binder is often employed in the emulsion coating to effect its adhesion to the resin. Conventionally gelatin is used as the binder although alternative synthetic materials are used.

The resin is normally a polyolefin, for example polyethylene, and it is largely due to this material that resin-coated base papers have met with commercial success. Unlike baryta coated photographic base papers, they are substantially impervious to water and photographic chemical processing solutions. They therefore require less drying time and consequently can be processed more quickly. In addition, they use less processing chemicals and are substantially free from distortion. This is of special concern to prints produced from the negative-positive process, especially colour prints, which generally require longer periods of immersion in the processing solutions than is the case with black and white printing paper.

If however, photographic prints made from resin coated base paper are subjected to variations in ambient conditions over long periods of time the image-containing and resin layers tend to deteriorate into a mass of cracks which are aesthetically undesirable and which, in extreme cases, extend over the entire print completely destroying the image. The manifestation of these cracks generally takes months and in some cases years, but can be accelerated if the print is exposed to extreme conditions, such as in the display windows of shops and offices where the problem is particularly acute. In fact, in such display windows cracking can occur within a matter of weeks, and the surface finish imparted to the resin does not seem to make any difference.

The fundamental cause of this cracking problem is shrouded in some uncertainty but it is believed to be due largely to a physical interaction between the image-containing layer and the resin layer. The generally accepted view is that differential expansion and contraction occurs between the image-containing and resin layers in accordance with changes in such ambient conditions as temperature and humidity. In a new photographic print, the resulting differential forces can be resisted by the resin coating and cracking is thus not apparent. But, as the print ages, the resin tends to degrade through the effect of light and/or heat radiation for instance, and gradually becomes embrittled. In this condition, the resin cannot readily resist the differential forces and this therefore frequently leads to the occurrence of cracking in the image-containing layer, or even both the image-containing and the resin layers.

The relatively low stability of the resin layer has been recognised for some time but problems have been experienced when a stabilising additive has been directly incorporated into the resin before it is coated on to the support. These problems include reduced adhesion between the resin and the paper support, and an impairment in the quality of the resin coating caused by the thermal degradation of the stabiliser during the extrusion coating operation. To overcome such problems, a process has been developed in which a stabiliser is incorporated into the paper support furnish or is coated on to the support. In both cases, the stabiliser is of a type that must be capable of migration into the subsequently applied resin layer so that its resistance to cracking can be maintained. In this way, the process affords a means of preventing cracking without any apparent reduction in the adhesion of the resin to the paper support and without any apparent impairment in the quality of the resin coating. Stabilisers are however costly materials and this process, which is described in British patent No. 1361219, uses a considerable amount.

It has now been found that the use of certain stabilisers in the resin coating substantially inhibits cracking. Moreover, these stabilisers can conveniently be admixed with the resin prior to extrusion coating of the resin on to the support without any significant detriment to the adhesion and quality requirements of the resin coating.

The present invention provides a photographic base paper having a resin coating which contains a stabiliser of formula (I),

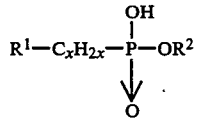

(I)

or a metal salt of the corresponding phosphonate anion, wherein $R^1$ is a sterically hindered hydroxphenyl, $R^2$ is $C_1$–$C_{12}$ alkyl, and x is 1 to 4.

The steric hindrance of the hydroxyphenyl is preferably achieved by one or more straight or branched chain $C_1$–$C_{12}$ alkyl groups, for example $C_1$–$C_7$ and $C_1$–$C_4$ alkyl groups, of which the most preferred is a t-butyl group. Optimally, the hydroxyphenyl is substituted by two such groups, one one each side of, and adjacent to, the hydroxy group, which itself is advantageously located in the para-position of the phenyl ring.

$R^2$ preferably represents a $C_1$–$C_8$, more preferably a $C_1$–$C_4$, alkyl group, for example, an ethyl group The denotation, x, is preferably 1.

The metal salt of the corresponding phosphonate anion, is of formula (II),

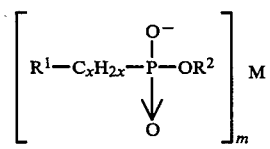

(II)

wherein $R^1$, $R^2$ and x are as defined previously, and M is a metal cation and n is from 1 to 4 and equal to the valency of M.

The metal salt is advantageously substantially colourless and n is preferably 2 and M is preferably nickel or calcium. The three most effective stabilisers falling within formula (I) appear to be O-ethyl-3,5-di-t-butyl-4-hydroxybenzylphosphonic acid and calcium and nickel bis-[O-ethyl-3,5-di-t-butyl-4-hydroxybenzyl phosphonate].

Processes are known in the art for preparing the stabilisers of formula (I). Briefly, the free acid is prepared by reacting an appropriate hydroxyaralkyl halide with a tertiary phosphite. The free acid may then be converted, if desired, into the metal salt by reacting it with a suitable metal derivative, such as the metal chloride. Alternatively, some of the metal salts can be obtained from commercial supplies and either used as such or converted back to the free acid using, for example, hydrochloric acid. The free acid so obtained may then be used itself in the invention or used as a starting material for conversion into another metal salt.

The stabilisers of use with the present invention prolong the life of a photographic print in an uncracked form, and their effectiveness is not diminished when photographic printing paper, produced from the base paper of the present invention, is subjected to the wide-ranging and adverse conditions that are normally encountered during photographic processing.

Photographic base paper usually has a resin coating on the wire side as well as the face side, and an even further advantage of the present invention is that the stabilisers of formula (I) do not substantially migrate from within the face side coating. This is an important feature of the present invention since resin coated photographic base paper is normally reeled up and stored as such for varying lengths of time. Whilst in this condition, the face side and the wire side resin coatings are in contact enabling a migratory stabiliser to transfer to the wire side resin coating where it would be of no benefit in preventing cracking. However, the stabilisers of formula (I) are substantially non-migratory and therefore this problem is not encountered.

The amount of stabiliser which can be used in the present invention varies widely, but generally the minimum effective amount is about 0.01%, by weight of the resin. The maximum amount of stabiliser above which there does not appear to be any additional benefit in preventing cracking is about 2%, by weight of the resin, and from 0.2 to 0.5% by weight of the resin would provide a very useful inhibitory effect against cracking.

In addition to a stabiliser of the above formula, other types of stabilisers may be included in the resin coating of the photographic base paper of the present invention. For example, a stabiliser capable of synergising the anticracking activity of a stabiliser of formula (I) is preferably included. Examples of such synergising stabilisers are those light stabilisers which are hindered amines. Light stabilisers of this kind are monomeric or preferably polymeric. An example of the less preferred monomeric hindered amine light stabiliser is bis{2,2,6,6-tetramethyl-4-piperidinyl}sebacate which is sold by Ciba-Geigy under the trade name of "Tinuvin 770". Examples of the more preferred polymeric hindered amine light stabilisers are those which are sold under the trade names "Tinuvin 622" and "Chimassorb 994" by Ciba-Geigy and Chimosa respectively. Hindered amine light stabilisers are used with advantage in the present invention.

The resin coating of the present invention may also include conventional additives—pigments, such as titanium dioxide, zinc oxide, barium sulphate, antimony trioxide, and carbon black; dyestuffs; optical brightening agents, such as Uvitex OB (Ciba-Geigy); and antistatic agents. Of course, if both a light stabiliser and an optical brightening agent are included, then they should absorb in different regions of the wavelength spectrum in order to obtain maximum benefit and to avoid competition for light of the same wavelength.

The resin itself is normally a polyolefine and preferably polyethylene which may be given a variety of surface finishes, such as glossy, matt, silk stipple, pyramid grain and lustre.

The base paper may contain synthetic fibres in addition to, or instead of, cellulose fibres.

The present invention also provides a process for the preparation of a photographic base paper which comprises incorporating a stabiliser of formula (I), or a metal salt thereof, into the resin mix and extrusion coating the resin mix on to base paper.

Prior to sensitizing, the resin coated photographic base paper is usually corona treated in order to ensure adequate adhesion between the image-containing layer and the resin layer. Such corona treatment is generally carried out by the photographic base paper manufacturer and to preserve the treatment until such time as the sensitizer can apply the image-containing layer, the treated resin is advisably immediately coated with an anti-adhesion decay solution, as described in British Pat. No. 1134211.

The present invention will now be further described with reference to a number of examples, the products of which were subjected to one or more of the following tests:

A. Cracking

Resin coated paper was emulsion coated using a chloro/bromide emulsion with a gelatine supercoat. After exposure, the photographic paper was processed as follows:

Developer: 1 minute
Fixer: ½ minute
Wash: 2 minutes

Exposed and developed samples were dried using an Ilfospeed 4250 dryer and the resulting print placed in a cabinet and subjected to alternating light and dark cycles with the following ambient conditions:

Light cycle (2 hours)—70°-80° C.(Max)—<15%RH
Dark cycle (2 hours)—30° C.(Min)—>80%RH The light was generated from four 150W Osram photoflood lamps placed 50 cm from the transparent top of the cabinet, and the airflow to the cabinet was 5 Liter/min for the light cycle and 10 Liter/min for the dark cycle.

The time was then determined for complete disintegration of the photographic image, i.e. when both the emulsion and resin layers had cracked to an extent that any information stored in the photographic image was lost.

B. Light Ageing

As polyethylene degrades, oxidation occurs causing the production of carbonyl groups. The measurement of carbonyl absorption provides therefore an indication of the degree of its degradation and a number of such measurements taken before, during and after light exposure enable inferences to be drawn regarding its ability to resist cracking.

Resin coated paper was therefore exposed to irradiation for a total of 400 hours in a Xenotest 150 Weatherometer. The ambient conditions in the apparatus were 25° C. and 50%RH. Measurement consisted of measuring the absorption of the sample at a wavelength of 1710 $cm^{-1}$ on an infra-red spectrophotometer before and after exposure throughout the test time. A graph was then plotted of the increase in carbonyl absorption against exposure time. From the graph the time was read at which the increase in carbonyl absorption reached 0.1 over unexposed resin coated paper.

C. Shade Degradation

Resin coated paper was heat aged in an oven of the circulating air type for 72 hours at 105° C. A shade degradation value was obtained by measuring the reflectance of the sample (with a constant backing paper) at 430 nm wavelength before and after ageing, and subtracting the results. Reflectance measurements were made with a Pretema FS3A spectromat.

D. Adhesion

The adhesion of the resin layer to the base paper was determined subjectively and the result given a grading of from 1 to 5. Good adhesion is indicated by a low number and bad adhesion by a high number.

EXAMPLE 1

A control faceside resin mix was made up according to the following formula:

50% $TiO_2$ in low density polyethylene: 7 kg

2% Uvitex OB in low density polyethylene: 1 kg

Low density polyethylene: 29.5 kg

The resulting mix was then coated on to base paper having a weight of 178 $g/m^2$ at a machine speed of 100 ft/min. The extrusion melt temperature was between 300° and 320° C. and the resulting coat weight was 40 $g/m^2$.

The test results for this conventional resin coated photographic base paper are recorded in Table 1.

EXAMPLE 2

Example 1 was repeated but with the addition to the resin mix of from 0.25 to 0.5%, by weight of the resin of Irgastab 2002HT (Ciba-Geigy), which is nickel bis-(O-ethyl-3,5-di-t-butyl-4-hydroxybenzyl phosphonate). Other types of stabilisers were also included (as a percentage weight of the resin) in some of the mixes.

The test results are recorded in Table 1.

EXAMPLE 3

Example 1 was repeated but with the addition to the resin mix of from 0.05 to 0.25%, by weight of the resin, of Irganox 1425 (Ciba-Geigy), which is calcium bis-(O-ethyl-3,5-di-t-butyl-4-hydroxybenzyl phosphonate). Other types of stabilisers were also included (as a percentage weight of the resin) in some of the mixes.

The test results are recorded in Table 1.

TABLE 1

| Example | Addition to Resin Mix | Test Results A/ Weeks | B/ Hours | C | D |
|---|---|---|---|---|---|
| 1 | — | 9 | 140 | 6.5 | 1 |
| 2 (i) | 0.5% Irgastab 2002HT | >20 | — | 8.6 | 1 |
| (ii) | 0.5% Irgastab 2002HT and 0.05% Irgafos 168 | >20 | — | 8.6 | 1 |
| (iii) | 0.25% Irgastab 2002HT | 21 | 285 | 6.4 | 1 |
| (iv) | 0.25% Irgastab 2002HT and 0.1% Tinuvin 622 | >33 | 530 | 7.4 | 1 |
| (v) | 0.25% Irgastab 2002HT and 0.05% Tinuvin 770 | >33 | 450* | 7.6 | 1 |
| 3 (i) | 0.05% Irganox 1425 | 14 | 470* | 6.0+ | 1 |
| (ii) | 0.25% Irganox 1425 | 17 | — | 6.4+ | 1 |
| (iii) | 0.05% Irganox 1425 and 0.1% Tinuvin 622 | >23 | — | 5.7+ | 1 |
| (iv) | 0.25% Irganox 1425 and 0.1% Tinuvin 622 | >23 | 830* | 7.1+ | 1 |
| (v) | 0.25% Irganox 1425 and 0.05% Tinuvin 770 | 16 | 490* | 6.7+ | 1 |

*The control result for these examples was 280.
+The control result for these examples was 5.8.

EXAMPLE 4

A control faceside resin mix was made up according to the following formula:

50% $TiO_2$ in low density polyethylene: 14 kg

2% Uvitex OB in low density polyethylene: 2.5 kg

Low density polyethylene: 58.5 kg

The resulting mix was coated as described in example 1 except that the machine speed was 260 ft/min. The resin coated paper was then emulsion coated, processed and tested. The results are given in Table 2.

EXAMPLE 5

Example 4 was repeated three times but with the addition of 0.2% Irgastab 2002HT with and without other materials. The results are given in Table 2.

TABLE 2

| Example | Addition to Resin Mix | Test Results A/ Weeks | B/ Hours | C | D |
|---|---|---|---|---|---|
| 4 | — | 9 | — | 5.2 | 1 |
| 5 (i) | 0.2% Irgastab 2002HT | >23 | — | 7.7 | 1 |
| (ii) | 0.2% Irgastab 2002HT and 0.1% Tinuvin 622 | >23 | — | 7.6 | 1 |
| (iii) | 0.2% Irgastab 2002HT and 0.05% Tinuvin 770 | >23 | — | 6.7 | 1 |

EXAMPLE 6

A control faceside resin mix was made up according to the following formula:

50% $TiO_2$ in low density polyethylene: 5 kg

2% Uvitex OB in low density polyethylene: 0.67 kg

Low density polyethylene: 19.33 kg

The resulting mix was coated as described in example 1.

The test results are given in Table 3.

EXAMPLE 7

Example 6 was repeated but with additions of Irganox 1425 and Tinuvin 622 to the resin mix.

The test results are given in Table 3.

EXAMPLE 8

Example 6 was repeated but with additions of Irgastab 2002HT and Tinuvin 770 to the resin mix.

The test results are given in Table 3.

TABLE 3

| Example | Addition to Resin Mix | Test Results B/ Hours | C | D |
|---|---|---|---|---|
| 6 | — | 140 | 6.5 | 1 |
| 7 (i) | 0.3% Irganox 1425 and 0.2% Tinuvin 622 | 1010 | 9.4 | 1 |
| (ii) | 0.5% Irganox 1425 and 0.2% Tinuvin 622 | 755 | 8.6 | 1 |

TABLE 3-continued

| Example | Addition to Resin Mix | Test Results B/ Hours | C | D |
|---|---|---|---|---|
| 8 (i) | 0.5% Irgastab 2002HT 0.1% Tinuvin 770 | 690* | 9.0 | 1 |
| (ii) | 0.2% Irgastab 2002HT and 0.15% Tinuvin 770 | 960* | 12.3 | 1 |
| (iii) | 0.3% Irgastab 2002HT and 0.2% Tinuvin 770 | 1550* | 12.9 | 1 |
| (iv) | 0.5% Irgastab 2002HT and 0.2% Tinuvin 770 | 1250* | 12.5 | 1 |

*The control result for these examples was 280

EXAMPLE 9

Example 6 was repeated twice—once exactly and once with the addition of O-ethyl-3,5-di-t-butyl-4-hydroxybenzylphosphonic acid to the resin mix.

The test results are given in Table 4.

TABLE 4

| Example | Addition to Resin Mix | Test Results B/ Hours | C | D |
|---|---|---|---|---|
| 9 (i) | — | 195 | 5.5 | 1 |
| (i) | 0.2% Free acid | 440 | 7.5 | 1 |

From the foregoing results, it can be clearly seen that the phenomenon of cracking is inhibited by the presence of a stabiliser of formula (I) in the resin faceside coating. Contrary to expectation, the stabiliser can be directly incorporated into the resin mix without any significant impairment in resin-base paper adhesion and in the visual quality of the resin coating.

What we claim is:

1. A base paper suitable for use in photographic prints having a polyolefin resin coating which contains a substantially nonmigratory stabilizer having been directly incorporated into the polyolefin resin and which is of the following structural formula:

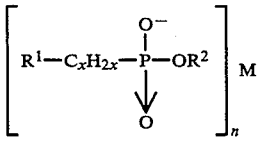

wherein $R^1$ is a sterically hindered hydroxyphenyl, $R^2$ is $C_1$–$C_{12}$ alkyl, and x is 1 to 4, M is hydrogen or a metal cation and n is 1 to 4 and equal to the valency of M, the coating also containing a titanium pigment and a light stabilizer.

2. A base paper according to claim 1, wherein the hydroxyphenyl is substituted by at least one straight or branched chain $C_1$–$C_{12}$ alkyl group.

3. A base paper according to claim 2, wherein the alkyl group is a $C_1$–$C_7$ alkyl group.

4. A base paper according to claim 3, wherein the alkyl group is a t-butyl group.

5. A base paper according to claim 1, wherein the hydroxyphenyl is substituted by two alkyl groups, one on each side of, and adjacent to, the hydroxy group.

6. A base paper according to claim 5, wherein the hydroxy group is in the para-position.

7. A base paper according to claim 1, wherein $R^2$ is a $C_1$–$C_8$ alkyl group.

8. A base paper according to claim 7, wherein the alkyl group is an ethyl group.

9. A base paper according to claim 1, wherein x is one.

10. A base paper according to claim 1, wherein the stabiliser is O-ethyl-3,5-di-t-butyl-4-hydroxybenzylphosphonic acid.

11. A base paper according to claim 1, wherein M is nickel or calcium.

12. A base paper according to claim 11, wherein the stabiliser is calcium or nickel bis(O-ethyl-3,5-di-t-butyl-4-hydroxybenzyl phosphonate).

13. A base paper according to claim 1 wherein the stabiliser is present in an amount from 0.01 to 2%, by weight of the resin.

14. A base paper according to claim 13, wherein the amount is from 0.2 to 0.5%, by weight of the resin.

15. A base paper according to claim 1, wherein the resin coating also contains a monomeric or polymeric hindered amine light stabiliser.

16. A base paper according to claim 15, wherein the light stabiliser is bis{2,2,6,6-tetramethyl-4-piperidinyl} sebacate.

17. A base paper according to claim 1, wherein the resin coating also contains an optical brightening agent.

18. A base paper according to claim 1, wherein the resin is polyethylene.

19. A base paper according to claim 1, wherein the resin coating has been corona treated.

20. A base paper according to claim 19, wherein a solution to retard the decay of the adhesiveness of a resin coating is applied to the corona treated resin coating.

21. Photographic printing paper which comprises a base paper according to claim 1 and an image-containing layer which is adhered to the resin coating.

22. Photographic printing paper according to claim 21, wherein the image-containing layer is an emulsion coating.

23. A Base paper according to claim 13, wherein the alkyl group is a $C_1$–$C_4$ alkyl group.

24. A base paper according to claim 7, wherein $R^2$ is a $C_1$–$C_4$ alkyl group.

25. Photographic element which comprises a base paper according to claim 20 and a light sensitive emulsion layer.

26. A process for the preparation of a base paper as defined in claim 1 suitable for use in photographic prints, which comprises incorporating a non-migratory stabilizer as defined in claim 1, a titanium pigment and a light stabilizer into the polyolefin resin mix and extrusion coating the resin mix onto the base paper.

* * * * *